US009854955B2

(12) United States Patent
Richter

(10) Patent No.: US 9,854,955 B2
(45) Date of Patent: Jan. 2, 2018

(54) FLOOR CARE SYSTEM WITH INTERCHANGEABLE AC AND DC VACUUM MOTOR ASSEMBLIES

(71) Applicant: Kaivac, Inc., Hamilton, OH (US)

(72) Inventor: John T. Richter, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 14/873,179

(22) Filed: Oct. 1, 2015

(65) Prior Publication Data

US 2017/0095129 A1 Apr. 6, 2017

Related U.S. Application Data

(60) Provisional application No. 62/058,256, filed on Oct. 1, 2014.

(51) Int. Cl.

| | |
|---|---|
| ***A47L 11/00*** | (2006.01) |
| ***A47L 11/30*** | (2006.01) |
| ***A47L 11/40*** | (2006.01) |

(52) U.S. Cl.

CPC ..... *A47L 11/4005* (2013.01); *A47L 11/30* (2013.01); *A47L 11/4016* (2013.01);

(Continued)

(58) Field of Classification Search

CPC .... A47L 11/30; A47L 11/405; A47L 11/4016; A47L 11/4044; A47L 11/4083; A47L 11/4088; A47L 11/34

See application file for complete search history.

(56) References Cited

U.S. PATENT DOCUMENTS 4,210,978 A 7/1980 Johnson
4,654,926 A * 4/1987 McCambridge ..... A47L 7/0042 15/327.6

(Continued)

OTHER PUBLICATIONS

PCT International Search Report ("ISR") for International Application No. PCT/US2015/053618, dated Feb. 11, 2016, Form PCT/ISA/210 (three pages), International Searching Authority, European Patent Office, Rijswijk, NL.

*Primary Examiner* — Dung Van Nguyen
(74) *Attorney, Agent, or Firm* — David E. Pritchard

(57) ABSTRACT

In one aspect of the invention, a portable floor care system with manually interchangeable AC and DC vacuum motor head assemblies for use in cleaning hard surface flooring may include: a reservoir defining an interior space operable to hold a cleaning liquid; a spigot fluidly connected to the reservoir interior space, the spigot manually adjustable through a range between a fully open position and a fully closed position, whereby when the reservoir contains a cleaning liquid, a user may dispense and regulate the flow of the cleaning liquid from the reservoir through the spigot by manually adjusting the spigot; a vacuum recovery tank; an AC vacuum motor head assembly and a DC vacuum motor head assembly manually and interchangeably fluidly connectable to the vacuum recovery tank; and a DC power supply assembly. In another aspect of the invention, a portable floor care system with manually interchangeable AC and DC vacuum motor head assemblies for use in cleaning hard surface flooring may include a reservoir assembly including: a reservoir defining an interior space operable to hold a cleaning liquid; a wheeled chassis; and a spigot fluidly connected to the reservoir interior space, the spigot manually adjustable through a range between a fully open position and a fully closed position, whereby when the reservoir contains a cleaning liquid, a user may dispense and (Continued)

regulate the flow of the cleaning liquid from the reservoir through the spigot by manually adjusting the spigot. The portable floor care system may further include: a vacuum recovery tank manually and removably positionable on the reservoir assembly; an AC vacuum motor head assembly and a DC vacuum motor head assembly interchangeably manually and removably positionable on the vacuum recovery tank in fluid communication with the vacuum recovery tank; and a DC power supply assembly manually and removably positionable on the reservoir assembly.

30 Claims, 5 Drawing Sheets

(52) U.S. Cl.
CPC ..... *A47L 11/4044* (2013.01); *A47L 11/4072* (2013.01); *A47L 11/4083* (2013.01); *A47L 11/4088* (2013.01)

(56) References Cited

U.S. PATENT DOCUMENTS 4,845,793 A * 7/1989 Meyer ..... A47L 5/225 15/323
8,074,321 B2 * 12/2011 Fry ..... A47L 5/225 15/327.2
2013/0125335 A1 * 5/2013 Robinson ..... A47L 5/225 15/320
2013/0139346 A1 * 6/2013 Robinson ..... A47L 11/4044 15/320

* cited by examiner

FLOOR CARE SYSTEM WITH INTERCHANGEABLE AC AND DC VACUUM MOTOR ASSEMBLIES

CROSS-REFERENCE TO RELATED APPLICATION

This patent document claims the benefit of the filing date of Provisional Application No. 62/058,256, entitled "Floor Care System with Interchangeable AC and DC Vacuum Motor Assemblies" and filed on Oct. 1, 2014. The entire disclosure of Provisional Application No. 62/058,256 is incorporated into this patent document by reference.

BACKGROUND OF THE INVENTION

This invention relates to floor care machines, and more particularly, to machines for cleaning hard surface flooring.

SUMMARY OF THE INVENTION

In one aspect of the invention, a portable floor care system with manually interchangeable AC and DC vacuum motor head assemblies for use in cleaning hard surface flooring may include: a reservoir defining an interior space operable to hold a cleaning liquid; a spigot fluidly connected to the reservoir interior space, the spigot manually adjustable through a range between a fully open position and a fully closed position, whereby when the reservoir contains a cleaning liquid, a user may dispense and regulate the flow of the cleaning liquid from the reservoir through the spigot by manually adjusting the spigot; a vacuum recovery tank; an AC vacuum motor head assembly and a DC vacuum motor head assembly manually and interchangeably fluidly connectable to the vacuum recovery tank; and a DC power supply assembly.

In another aspect of the invention, a portable floor care system with manually interchangeable AC and DC vacuum motor head assemblies for use in cleaning hard surface flooring may include a reservoir assembly including: a reservoir defining an interior space operable to hold a cleaning liquid; a wheeled chassis; and a spigot fluidly connected to the reservoir interior space, the spigot manually adjustable through a range between a fully open position and a fully closed position, whereby when the reservoir contains a cleaning liquid, a user may dispense and regulate the flow of the cleaning liquid from the reservoir through the spigot by manually adjusting the spigot. The portable floor care system may further include: a vacuum recovery tank manually and removably positionable on the reservoir assembly; an AC vacuum motor head assembly and a DC vacuum motor head assembly interchangeably manually and removably positionable on the vacuum recovery tank in fluid communication with the vacuum recovery tank; and a DC power supply assembly manually and removably positionable on the reservoir assembly.

BRIEF DESCRIPTION OF THE DRAWINGS

The accompanying drawings, which are incorporated into this patent document and constitute a part of this specification, illustrate embodiments of the invention and, together with the general description of the invention given above, and the detailed description of the drawings given below, serve to explain the principles of the invention.

DETAILED DESCRIPTION OF THE DRAWINGS

Figure 1:
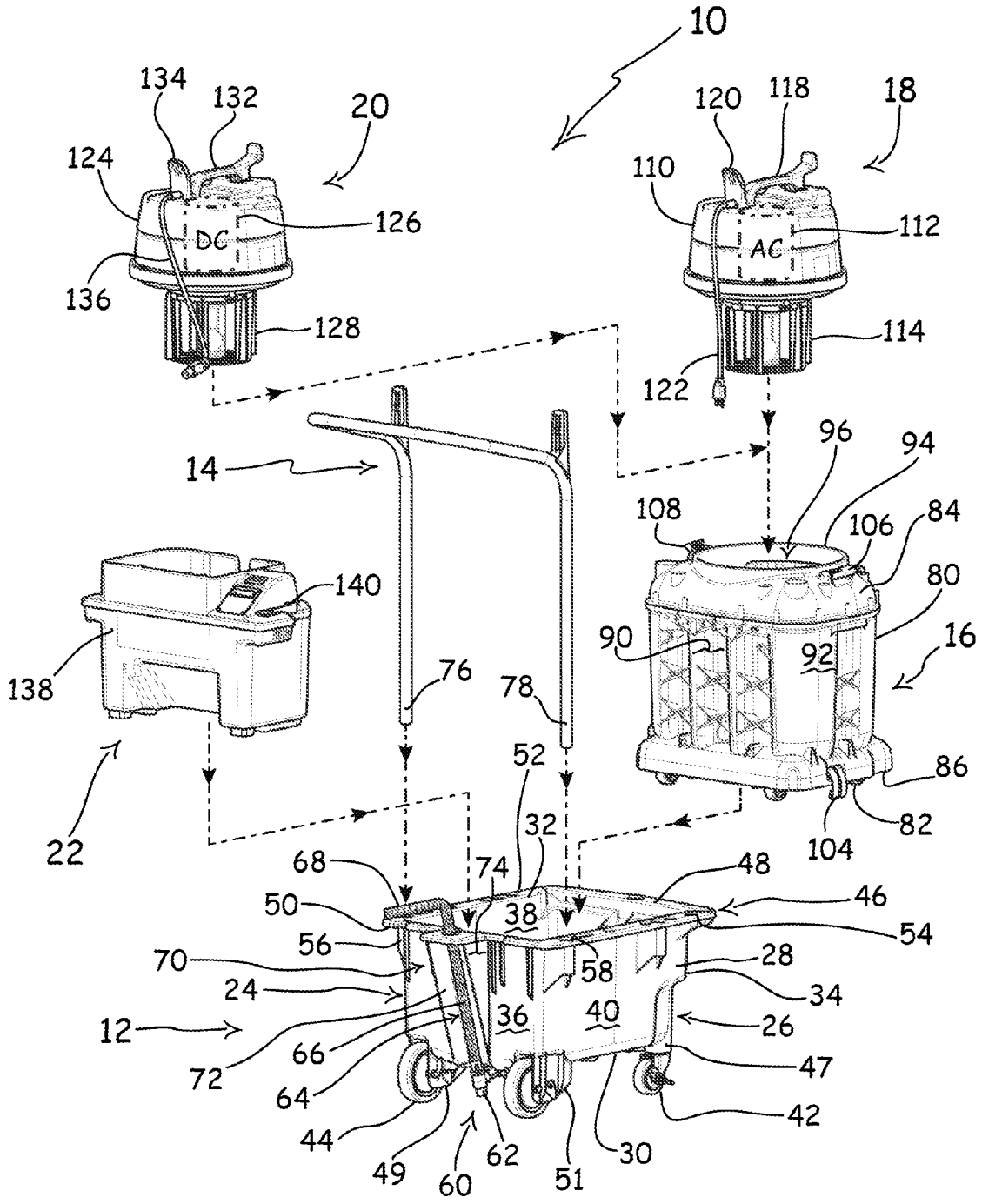
FIG. 1 is an exploded view of a particular embodiment of the portable floor care system with manually interchangeable AC and DC vacuum motor head assemblies for use in cleaning hard surface flooring, in accordance with the principles of the invention.
Figure 2:
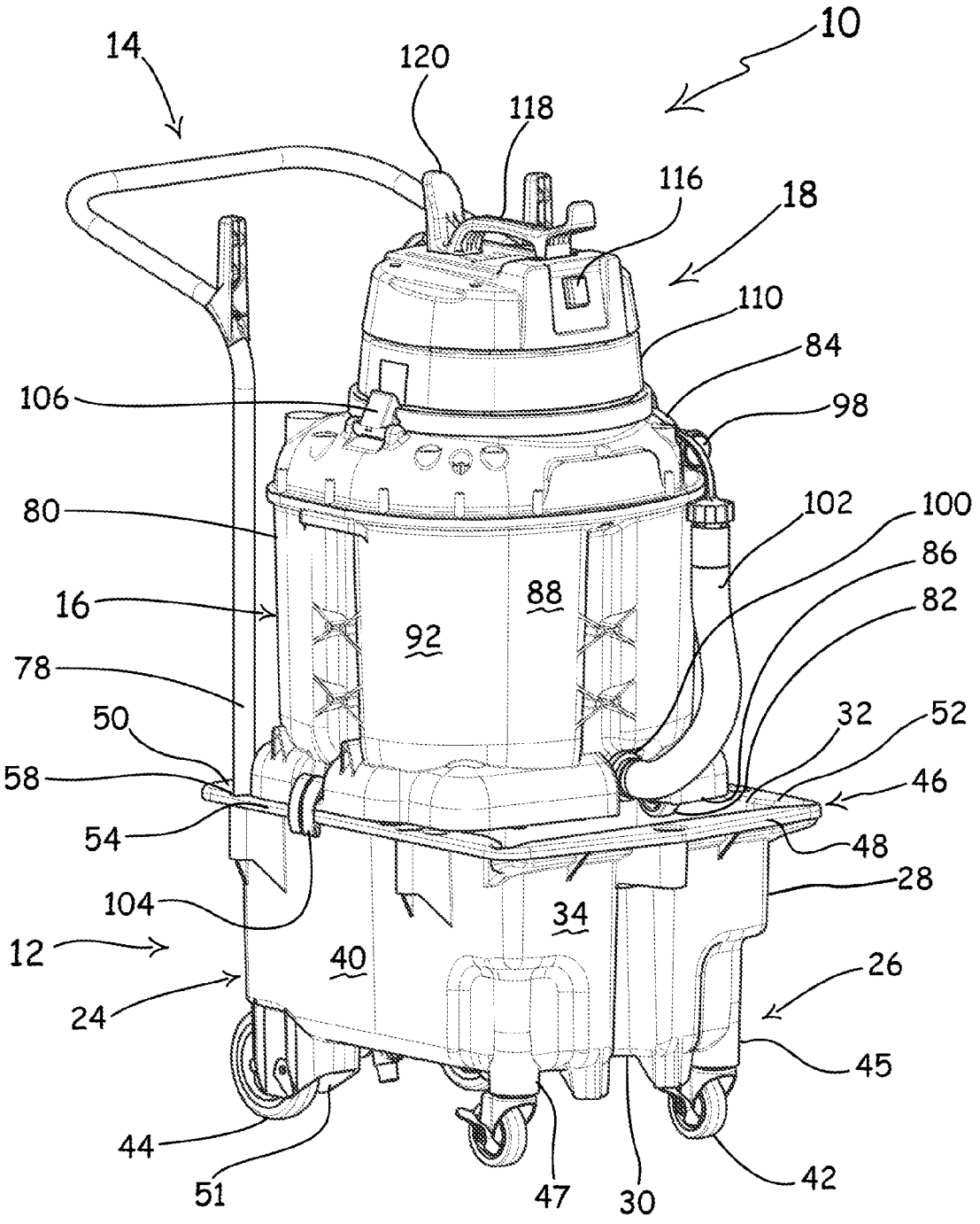
FIG. 2 is a perspective view of a portion of the floor care system of FIG. 1 in an AC power configuration, in which: the interchangeable AC vacuum motor head assembly is removably positioned on and releasably connected to the vacuum recovery tank; and the vacuum recovery tank is removably positioned on and releasably connected to the reservoir. The interchangeable DC vacuum motor head assembly and the DC power supply assembly of the floor care system of FIG. 1 are not shown.
Figure 3:
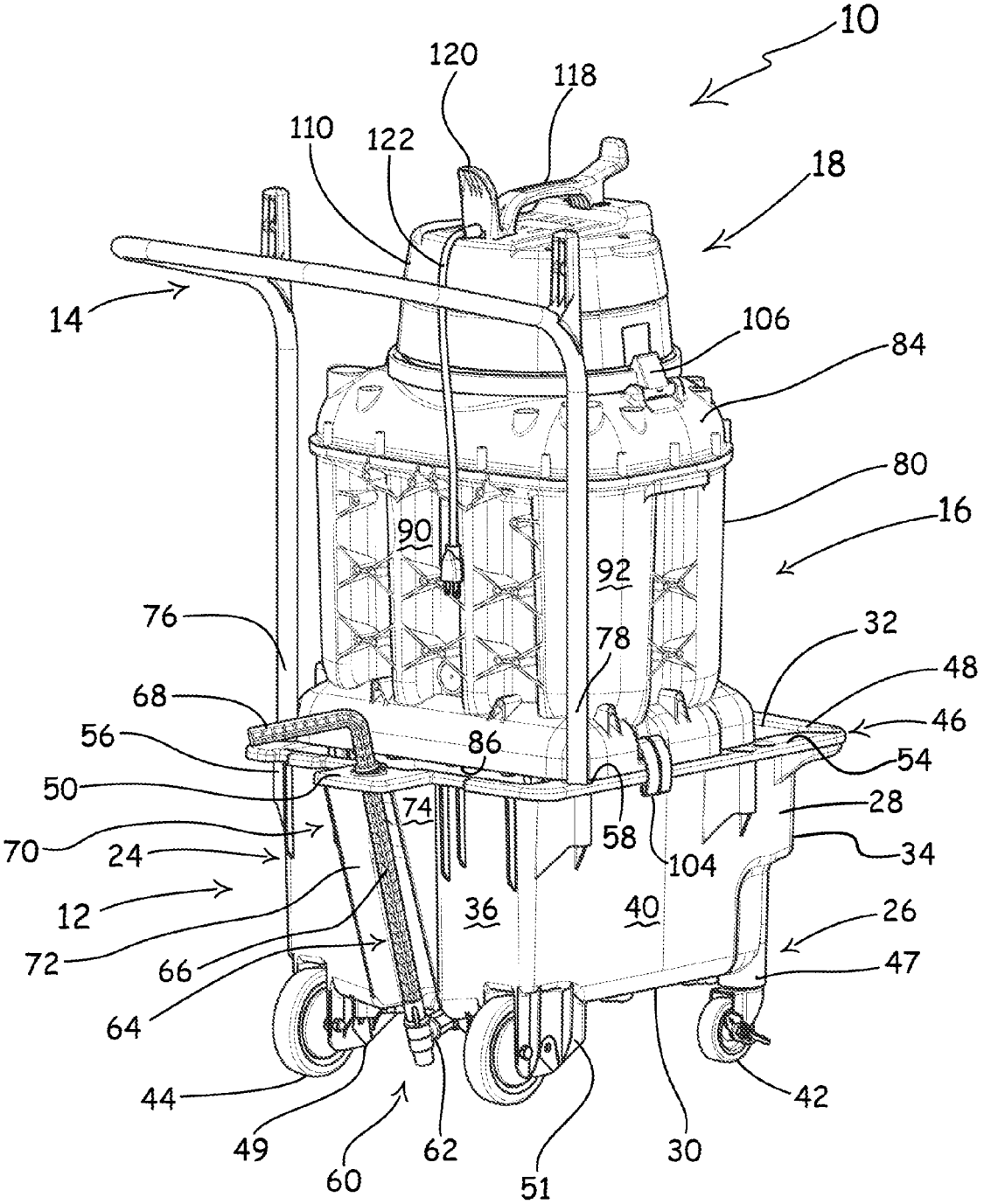
FIG. 3 is another perspective view of the portion of the floor care system of FIG. 1 in the AC power configuration shown in FIG. 2.
Figure 4:
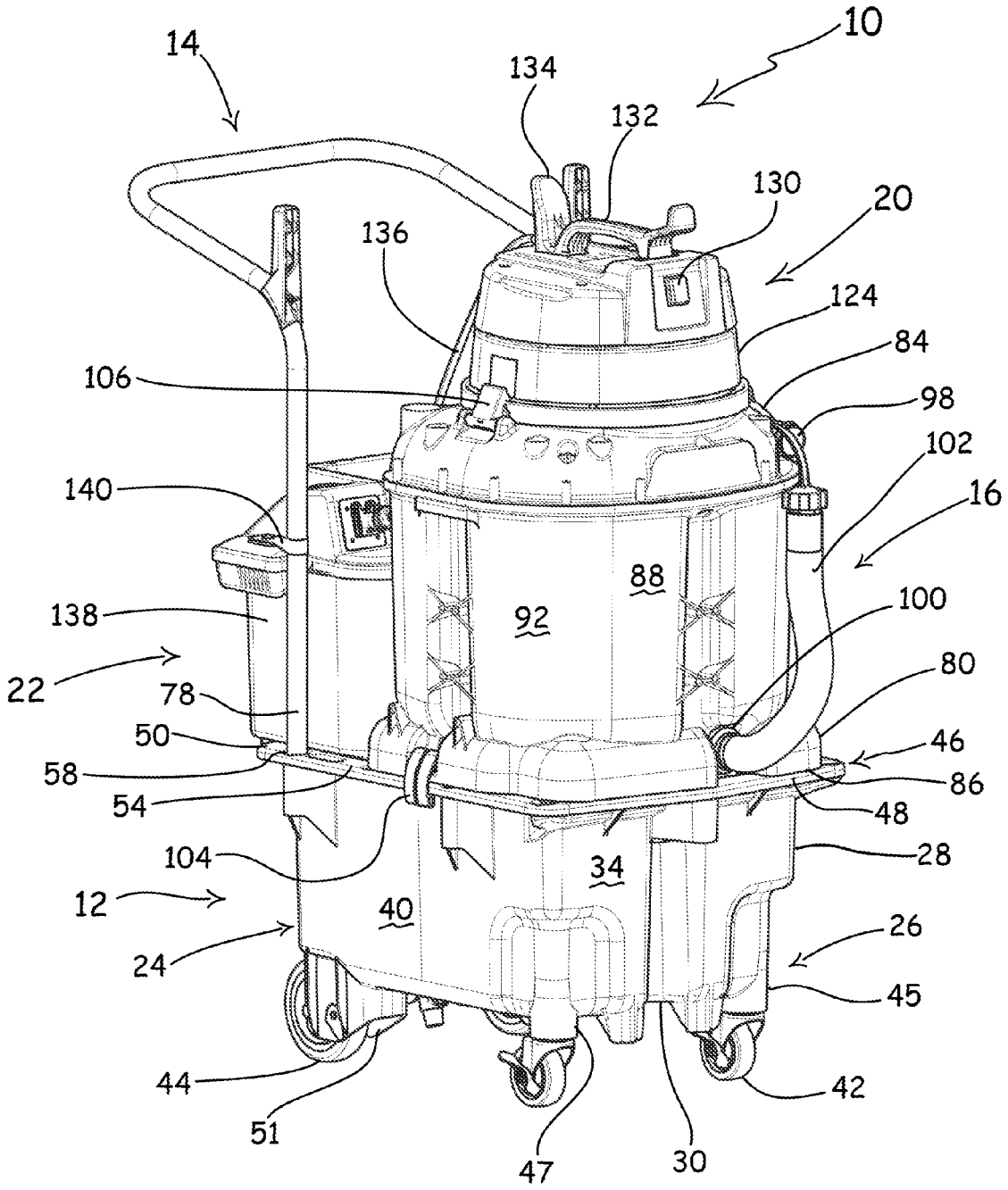
FIG. 4 is a perspective view of a portion of the floor care system of FIG. 1 in a DC power configuration, in which: the interchangeable DC vacuum motor head assembly is removably positioned on and releasably connected to the vacuum recovery tank; the vacuum recovery tank is removably positioned on and releasably connected to the reservoir; and the DC power supply assembly is removably positioned on and releasably connected to the reservoir. The interchangeable AC vacuum motor head assembly of the floor care system of FIG. 1 is not shown.
Figure 5:
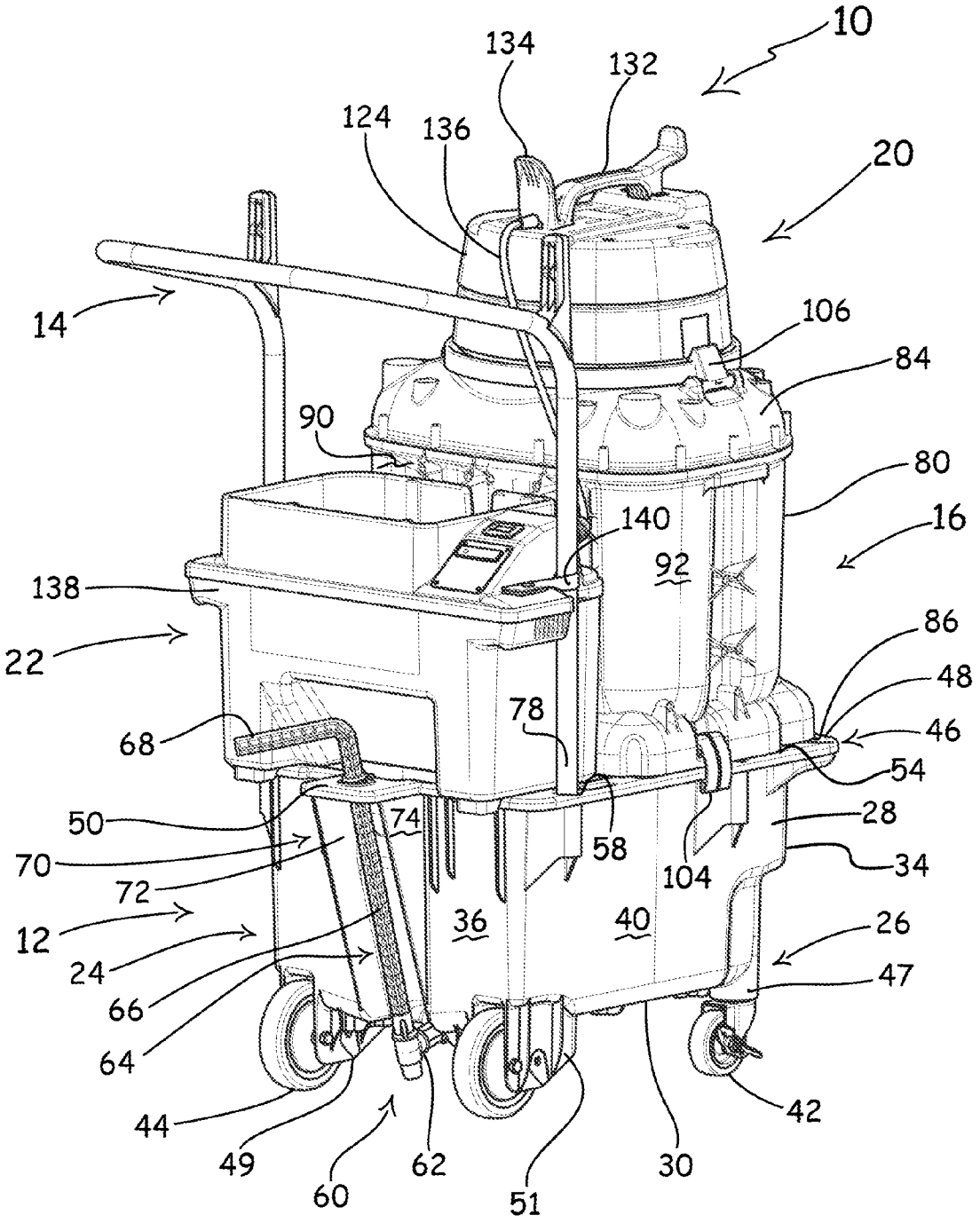
FIG. 5 is another perspective view of the portion of the floor care system of FIG. 1 in the DC power configuration shown in FIG. 4.

With reference to FIGS. 1-5, a particular embodiment 10 of the portable floor care system with manually interchangeable AC and DC vacuum motor head assemblies for use in cleaning hard surface flooring, in accordance with the principles of the invention, is shown. The portable floor care system embodiment 10 has a reservoir assembly 12, a handle in the form of a four-bend handle 14, a vacuum recovery tank assembly 16, an AC vacuum motor head assembly 18 and a DC vacuum motor head assembly 20 with each vacuum motor head assembly 18, 20 manually and interchangeably fluidly connectable to the vacuum recovery tank assembly, and a DC power supply assembly 22.

As is understood by one of ordinary skill in the art, "AC" is an abbreviation for alternating current; and "DC" is an abbreviation for direct current.

The portable floor care system embodiment 10, described in further detail below, provides many benefits and advantages. For example, a user can switch from AC to DC operation (and vice versa) in a matter of seconds—simply by taking the interchangeable AC vacuum motor head assembly off of the vacuum recovery tank, putting the interchangeable DC vacuum motor head assembly on the vacuum recovery tank, and putting the DC power supply assembly on the reservoir—these few steps being done manually without the use of tools. When switching from DC to AC operation, the few steps are simply reversed—again being done manually without the use of tools. And when switching from DC to AC operation, the user may if desired keep the DC power supply assembly in its same position on the reservoir.

The reservoir assembly 12 has a reservoir 24 and a wheeled chassis 26 integral with the reservoir. The reservoir has a circumferential sidewall 28, a bottom wall 30, and an upper end 32—with the circumferential sidewall including a front wall 34, a back wall 36, a left sidewall 38, and a right sidewall 40. The reservoir defines an interior space, and the reservoir upper end defines an opening—with the reservoir capable of holding a cleaning liquid (e.g., water or another cleaning liquid or solution). The wheeled chassis has four wheels—two swivel casters at the front (as at 42), and two fixed-axle wheels at the back (as at 44). At the front, the wheeled chassis includes a reinforced post or leg 45 at the front lower-left corner, and a reinforced post or leg 47 at the front lower-right corner. Each of these legs includes a cylindrical bore for receiving the post of the corresponding caster. At the back, the wheeled chassis includes a wheel frame 49 at the back lower-left corner, and a wheel frame 51 at the back lower-right corner. If desired, the reservoir and the integral wheeled chassis also may be referred to as a trolley bucket.

The reservoir 24 further has a top wall 46 at the reservoir upper end 32. The top wall is integral with the circumferential sidewall 28, and extends outward away from the circumferential sidewall and reservoir interior space. The top wall has a front section 48, a back section 50, a left section 52, and a right section 54—with each top wall section integral with an adjacent top wall section. The top wall left section has a cylindrical bore 56; and the top wall right section has a cylindrical bore 58. Each of the cylindrical bores has a bottom wall, with the bottom wall including an opening for drainage. One way in which the cylindrical bores 56, 58 may be used is discussed below, in connection with the four-bend handle 14.

The reservoir assembly 12 further has a spigot assembly 60 at the back of the reservoir 24. The spigot assembly includes a spigot 62 and a spigot handle 64 connected to the spigot. The spigot is fluidly connected to the reservoir interior space; and the spigot has a valve that facilitates the spigot's ability to dispense and regulate the flow of a cleaning liquid from the reservoir through the spigot. The spigot handle is an elongated member in the form of an elongated rod that extends upward from the spigot. The spigot handle has an upwardly extending section 66 and a horizontal section 68 at the top of the upwardly extending section. A frame 70 extends rearward from the back wall 36 of the reservoir; and the upwardly extending section of the spigot handle extends through an opening in the top wall of the frame. In further detail, the frame includes the top wall (a portion of the back section 50 of the top wall 46 of the reservoir 24), a left sidewall 72, and a right sidewall 74. The left sidewall is positioned to the left of the spigot-handle upwardly extending section; and the right sidewall is positioned to the right of the spigot-handle upwardly extending section. The left and right sidewalls extend rearward from the reservoir back wall and are integral with the reservoir back wall and the frame top wall.

In use, a user typically operates the spigot handle 64 by grasping the horizontal section 68 and turning the section to the right or to the left. The spigot 62 is manually adjustable through a range from a fully open position to a fully closed position, whereby when the reservoir 24 contains a cleaning liquid, a user may dispense and regulate the flow of the cleaning liquid from the reservoir through the spigot by manually turning the spigot handle a desired amount to the right or to the left, thereby adjusting the spigot.

Various embodiments of the portable floor care system, in accordance with the principles of the invention, may be configured: (1) so that at least a portion of the cleaning liquid dispensed from the reservoir through the spigot flows directly from the spigot onto an area of hard surface flooring; (2) so that all of the cleaning liquid dispensed from the reservoir through the spigot flows directly from the spigot onto an area of hard surface flooring; (3) so that at least a portion of the cleaning liquid dispensed from the reservoir through the spigot flows indirectly from the spigot onto an area of hard surface flooring; and (4) so that all of the cleaning liquid dispensed from the reservoir through the spigot flows indirectly from the spigot onto an area of hard surface flooring. One example of cleaning liquid flowing indirectly from the spigot onto an area of hard surface flooring involves a configuration in which cleaning liquid flows from the spigot to a liquid spreader device or assembly, and from the liquid spreader device or assembly to the hard surface flooring.

Additional aspects of the reservoir assembly are shown and described in: (1) U.S. Pat. No. 8,544,741, entitled "Cleaning Cart Systems" and issued on Oct. 1, 2013. (2) U.S. patent application Ser. No. 13/477,040, entitled "Modular Multi-Functional Cleaning and Floor Care System" and filed on May 21, 2012; and (3) U.S. Patent Application Publication No. US 2013/0125335, entitled "Modular Multi-Functional Cleaning and Floor Care System" and published on May 23, 2013. The entire disclosure of each of (1) U.S. Pat. No. 8,544,141, (2) U.S. patent application Ser. No. 13/477,040, and (3) U.S. Patent Application Publication No. U.S 2013/0175335 is incorporated into this patent document by reference.

Further aspects of the reservoir assembly are shown and described in: (1) U.S. patent application Ser. No. 13/563,718, entitled "Multi-Functional Cleaning and Floor Care System" and filed on Jul. 31, 2012; and (2) U.S. Patent Application Publication No. U.S 2013/0139346, entitled "Multi-Functional Cleaning and Floor Care System" and published on Jun. 6, 2013. The entire disclosure of each of (1) U.S. patent application Ser. No. 13/563,718 and (2) U.S. Patent Application Publication No. US 2013/0139346 is incorporated into this patent document by reference.

The vacuum recovery tank assembly 16 includes a vacuum recovery tank 80, four swivel caster wheels (as at 82) at the base of the tank, a dump hose 102 at the front of the tank, two fasteners in the form of hand-operable latches (as at 104) at the base of the tank, and two fasteners in the form of hand-operable latches 106, 108 at the top of the tank.

The vacuum recovery tank 80 has a top wall 84, a bottom wall 86, a front wall 88, a back wall 90, a left sidewall (not shown), and a right sidewall 92; and the tank defines an interior space operable to hold liquid and soil (e.g., soil-containing cleaning solution that has been vacuumed up from an area of hard surface flooring). The tank also has a vacuum recovery inlet 98 at a front left portion of the top wall 84, and a dump outlet 100 at a lower portion of the front wall 88. Both the vacuum recovery inlet and the dump outlet are fluidly connected to the tank interior space. In addition, the tank-assembly dump hose 102 is fluidly connected to the dump outlet 100. In this fashion, liquid and soil may be suctioned into the tank via the vacuum recovery inlet (e.g., via a length of vacuum hose connected to a floor tool or the like); and liquid and soil may be drained from the tank via the dump outlet and the dump hose (e.g., into a suitable receptacle, drain, or the like.) The top wall 84 has a circumferential rim 94 that defines a large opening 96. The opening provides a user with access to the tank interior space. The opening also enables either of the interchangeable AC and DC vacuum motor head assemblies 18, 20 (discussed in detail below) to be in fluid communication with the tank interior space when a user manually and removably positions (e.g., seats) either of the assemblies 18, 20 on the top wall 84 about the opening 96.

With regard to the fasteners, and as mentioned briefly above, two fasteners in the form of hand-operable latches (as at 104) are located at the base of the vacuum recovery tank 80. In further detail, one of the latches (as at 104) at the base of the tank is located at the tank right sidewall 92, and the other of the latches (not shown) at the base of the tank is located at the tank left sidewall (not shown). In use, a user may manually and removably position the tank on the reservoir, and may do so without the use of a tool. With the tank on the reservoir, a user may manually and releasably connect the tank to the reservoir via the hand-operable latches (as at 104), and may do so without the use of a tool.

With further regard to the fasteners, and as mentioned briefly above, two fasteners in the form of hand-operable latches 106, 108 are located at the top of the vacuum recovery tank 80. In additional detail, latch 106 at the top of the tank is located at the tank top wall 84 to the right of the large opening 96, and latch 108 at the top of the tank is located at the tank top wall 84 to the left of the large opening 96. In use, a user may manually and removably position (e.g., seat) either one of the interchangeable AC and DC vacuum motor head assemblies 18, 20 (discussed in detail below) on the top wall 84 about the opening 96. When either of the interchangeable assemblies 18, 20 is positioned on the top wall 84 about the opening 96, a user may manually and releasably connect the positioned assembly to the vacuum recovery tank via the hand-operable latches 106, 108, and may do so without the use of a tool.

The four bend handle 14 is manually and removably connected to the reservoir 24. As noted above, the reservoir has a top wall 46 at the reservoir upper end 32. The top wall is integral with the reservoir circumferential sidewall 28, extends outward away from the circumferential sidewall and reservoir interior space, and has several sections. The top-wall left section 52 has a cylindrical bore 56, and the top-wall right section 54 has a cylindrical bore 58—with each of the cylindrical bores having a bottom wall. The four bend handle 14 has a left leg 76 and a right leg 78. In manually and removably connecting the four bend handle to the reservoir, the left leg is positioned in the cylindrical bore 56, and the right leg is positioned in the cylindrical bore 58.

The interchangeable AC vacuum motor head assembly 18 has an outer housing 110, an AC vacuum motor assembly 112, and an automatic shutoff system in the form of a float shutoff assembly 114. The outer housing has an on/off switch 116, a main handle 118, a steering tab or handle 120, and an AC power cord 122 for manual and removable connection to a suitable AC electrical cord—for example, an AC electrical cord connectable to a conventional wall outlet. In use, a user may grasp or otherwise exert force on the steering tab to facilitate moving (e.g., pushing or pulling) the portable floor care system 10. The AC vacuum motor assembly 112 may have any suitable specifications. For example, if desired, the AC vacuum motor assembly may have a vacuum lift of 80 inches of water and an air flow of 60 cubic feet per minute. Alternatively, if desired, the AC vacuum motor assembly may have a vacuum lift of 77 inches of water and an air flow of 62 cubic feet per minute.

The interchangeable DC vacuum motor head assembly 20 has an outer housing 124, a DC vacuum motor assembly 126, and an automatic shutoff system in the form of a float shutoff assembly 128. The outer housing has an on/off switch 130, a main handle 132, a steering tab or handle 134, and a DC power cord 136 for manual and removable connection to the DC power supply assembly 22 (discussed below). In use, a user may grasp or otherwise exert force on the steering tab to facilitate moving (e.g., pushing or pulling) the portable floor care system 10. The DC vacuum motor assembly 126 may have any suitable specifications. For example, if desired, the DC motor of the DC vacuum motor assembly may be a 36 volt DC motor. Also, if desired, the DC vacuum motor assembly may have a vacuum lift of 80 inches of water and an air flow of 60 cubic feet per minute. Alternatively, if desired, the DC vacuum motor assembly may have a vacuum lift of 77 inches of water and an air flow of 62 cubic feet per minute.

The DC power supply assembly 22 has a rechargeable Lithium-ion battery positioned in a battery box 138. The Lithium-ion battery may have any suitable specifications. For example, if desired, the Lithium-ion battery may be a 36 volt DC battery with a 20 amp hour rating. The DC power supply assembly also has a fastener in the form of a strap 140 connected to an exterior surface of the battery box. If desired, the strap may have a male snap member and a corresponding female snap member. In use, a user may manually and removably position the DC power supply assembly on the reservoir, and may do so without the use of a tool. With the DC power supply assembly on the reservoir, a user may manually and releasably connect the DC power supply assembly to the reservoir via a fastener assembly, and may do so without the use of a tool. If desired, the fastener assembly may include the strap 140 and the leg 78 of the four bend handle 14. For example, with the handle manually and removably connected to the reservoir (as discussed above), a user may wrap a portion of the strap 140 around the leg 78, and releasably secure the male and female snap members to one another.

Typically a portable floor care system of the present invention does not include a pump to assist in dispensing cleaning liquid from the reservoir through the spigot—either directly or indirectly onto an area of hard surface flooring. Instead, such a portable floor care system uses the natural force of gravity to facilitate dispensing cleaning liquid from the reservoir through the spigot. With reference to the Figures, the portable floor care system embodiment 10 is free of such a pump.

A portable floor care system of the present invention may be made using any suitable material(s) and manufacturing technique(s). For example, if desired, the reservoir may be made of polypropylene using injection molding, and the vacuum recovery tank may be made of polyethylene via rotational molding.

When the interchangeable AC vacuum motor head assembly 18 is positioned on the vacuum recovery tank 80, the portable floor care system 10 is in what may be referred to as an AC power configuration. And when the interchangeable DC vacuum motor head assembly 20 is positioned on the vacuum recovery tank 80, and the DC power supply assembly 22 is positioned on the reservoir 24, the floor care system is in what may be referred to as a DC power configuration.

It is extremely easy for a user to switch a portable floor care system with manually interchangeable AC and DC vacuum motor head assemblies for use in cleaning hard surface flooring, in accordance with the principles of the invention, back and forth between an AC power configuration and a DC power configuration. For example, if a user wants to switch from an AC power configuration to a DC power configuration, the user may simply unplug (e.g., from a conventional AC wall outlet) and stow an AC electrical cord, unfasten and remove the AC vacuum motor head assembly from the vacuum recovery tank, and set the AC vacuum motor head assembly aside in a suitable location. The user then may: position the vacuum recovery tank in a more-forward orientation on the reservoir; position the DC vacuum motor head assembly on, and fasten it to, the vacuum recovery tank; mount the DC power supply assembly on the reservoir assembly, adjacent and rearward of the vacuum recovery tank; and electrically connect the DC vacuum motor assembly to the DC power supply assembly by plugging a DC vacuum motor head assembly power cord into the DC power supply assembly.

In use, a portable floor care system of the present invention—with its interchangeable AC and DC power configurations on a single product platform—provides numerous benefits and advantages.

Because each of the interchangeable AC and DC vacuum motor head assemblies and the DC power supply assembly is easy to install and to remove, a user may shift between AC and DC power swiftly and easily, as needed or desired for particular cleaning applications.

Some cleaning applications may benefit more from an AC power configuration, while other cleaning applications may benefit more from a DC power configuration. For example, if a particular cleaning application involves high power consumption or a very long cleaning time, and if AC outlets are readily available, then an AC power configuration may be preferred. Alternatively, in a cleaning application where it might be cumbersome to maneuver or manage an AC electrical cord (e.g., cleaning around tables and chairs in some large cafeterias), or if AC outlets are not readily available, or in a cleaning application where the use of an AC electrical cord is not permitted (e.g., some food-service cleaning applications), then a DC power configuration may be preferred or required.

In addition, if or when the DC power supply assembly is depleted, a user can continue cleaning by quickly exchanging the DC vacuum motor head assembly for the AC vacuum motor assembly and plugging an AC electrical cord into a nearby AC electrical outlet. Also, because the AC and DC power configurations are interchangeable on a single product platform, a purchaser of machines for cleaning hard surface flooring does not have to buy separate AC and DC machines; accordingly, the portable floor care system of the invention provides significant cost savings.

While the present invention has been illustrated by a description of embodiments, and while the illustrative embodiments have been described in considerable detail, it is not the intention of the inventor to restrict or in any way limit the scope of the following claims to such detail. Additional advantages and modifications readily will appear to those skilled in the art upon a reading of this patent document. The invention, in its broader aspects, is therefore not limited to the specific details, representative apparatus and methods, and illustrative examples shown and described in this patent document. Accordingly, departures may be made from such details without departing from the spirit or scope of the inventor's general inventive concept.

What is claimed is:

1. A portable floor care system with manually interchangeable AC and DC vacuum motor head assemblies for use in cleaning hard surface flooring, comprising:

a reservoir defining an interior space operable to hold a cleaning liquid;

a spigot fluidly connected to the reservoir interior space, the spigot manually adjustable through a range between a fully open position and a fully closed position, whereby when the reservoir contains a cleaning liquid, a user may dispense and regulate the flow of the cleaning liquid from the reservoir through the spigot by manually adjusting the spigot;

a vacuum recovery tank;

an AC vacuum motor head assembly and a DC vacuum motor head assembly manually and interchangeably fluidly connectable to the vacuum recovery tank; and a DC power supply assembly.

2. The floor care system of claim 1 wherein the AC vacuum motor head assembly includes an outer housing and an AC vacuum motor assembly, and the DC vacuum motor head assembly includes an outer housing and a DC vacuum motor assembly.

3. The floor care system of claim 2 wherein the AC vacuum motor head assembly further includes an automatic shutoff system, and the DC vacuum motor head assembly further includes an automatic shutoff system.

4. The floor care system of claim 1 wherein the vacuum recovery tank is manually and removably positionable on the reservoir.

5. The floor care system of claim 1 further including a fastener configured to enable a user to manually and releasably connect the vacuum recovery tank to the reservoir without the use of a tool.

6. The floor care system of claim 1 wherein the AC vacuum motor head assembly and the DC vacuum motor head assembly are interchangeably manually and removably positionable on the vacuum recovery tank.

7. The floor care system of claim 1 further including a fastener configured to enable a user:

to manually and releasably connect the AC vacuum motor head assembly to the vacuum recovery tank without the use of a tool; and to manually and releasably connect the DC vacuum motor head assembly to the vacuum recovery tank without the use of a tool.

8. The floor care system of claim 1 further including a fastener configured to enable a user to manually and releasably connect the AC vacuum motor head assembly to the vacuum recovery tank without the use of a tool.

9. The floor care system of claim 1 further including a fastener configured to enable a user to manually and releasably connect the DC vacuum motor head assembly to the vacuum recovery tank without the use of a tool.

10. The floor care system of claim 1 wherein the DC power supply assembly is manually and removably positionable on the reservoir.

11. The floor care system of claim 1 further including a fastener assembly configured to enable a user to manually and releasably connect the DC power supply assembly to the reservoir without the use of a tool.

12. The floor care system of claim 11 wherein the fastener assembly includes a handle and a fastener, the handle connected to the reservoir, and the fastener connected to the DC power supply assembly and connectable to the handle.

13. The floor care system of claim 1 further including a plurality of wheels configured to support the reservoir, whereby a user may manually wheel the reservoir across an area of hard surface flooring.

14. The floor care system of claim 1 wherein the reservoir includes a back wall, and the spigot is at the back wall.

15. The floor care system of claim 1 further including a spigot handle connected to the spigot, the spigot handle comprising an elongated upwardly-extending member, whereby a user may manually adjust the spigot by manually rotating the spigot handle.

16. The floor care system of claim 1 wherein the DC power supply assembly comprises a Lithium-ion battery.

17. The floor care system of claim 1 wherein the system does not include a pump to assist in dispensing cleaning liquid from the reservoir through the spigot.

18. A portable floor care system with manually interchangeable AC and DC vacuum motor head assemblies for use in cleaning hard surface flooring, comprising:

a reservoir assembly including:

a reservoir defining an interior space operable to hold a cleaning liquid;

a wheeled chassis; and a spigot fluidly connected to the reservoir interior space, the spigot manually adjustable through a range between a fully open position and a fully closed position, whereby when the reservoir contains a cleaning liquid, a user may dispense and regulate the flow of the cleaning liquid from the reservoir through the spigot by manually adjusting the spigot;

a vacuum recovery tank manually and removably positionable on the reservoir assembly;

an AC vacuum motor head assembly and a DC vacuum motor head assembly interchangeably manually and removably positionable on the vacuum recovery tank in fluid communication with the vacuum recovery tank; and a DC power supply assembly manually and removably positionable on the reservoir assembly.

19. The floor care system of claim 18 further including a fastener configured to enable a user to manually and releasably connect the vacuum recovery tank to the reservoir assembly without the use of a tool.

20. The floor care system of claim 19 further including a fastener configured to enable a user:

to manually and releasably connect the AC vacuum motor head assembly to the vacuum recovery tank without the use of a tool; and to manually and releasably connect the DC vacuum motor head assembly to the vacuum recovery tank without the use of a tool.

21. The floor care system of claim 20 further including a fastener assembly configured to enable a user to manually and releasably connect the DC power supply assembly to the reservoir assembly without the use of a tool.

22. The floor care system of claim 21 wherein the fastener assembly includes a handle and a fastener, the handle connected to the reservoir, and the fastener connected to the DC power supply assembly and connectable to the handle.

23. The floor care system of claim 18 further including a fastener configured to enable a user:

to manually and releasably connect the AC vacuum motor head assembly to the vacuum recovery tank without the use of a tool; and to manually and releasably connect the DC vacuum motor head assembly to the vacuum recovery tank without the use of a tool.

24. The floor care system of claim 18 further including a fastener assembly configured to enable a user to manually and releasably connect the DC power supply assembly to the reservoir assembly without the use of a tool.

25. The floor care system of claim 24 wherein the fastener assembly includes a handle and a fastener, the handle connected to the reservoir, and the fastener connected to the DC power supply assembly and connectable to the handle.

26. The floor care system of claim 18 wherein the reservoir is integral with the wheeled chassis.

27. The floor care system of claim 18 wherein the reservoir includes a back wall, and the spigot is at the back wall.

28. The floor care system of claim 18 further including a spigot handle connected to the spigot, the spigot handle comprising an elongated upwardly-extending member, whereby a user may manually adjust the spigot by manually rotating the spigot handle.

29. The floor care system of claim 18 wherein the DC power supply assembly comprises a Lithium-ion battery.

30. The floor care system of claim 1 wherein the system does not include a pump to assist in dispensing cleaning liquid from the reservoir through the spigot.

* * * * *